US006532914B2

(12) United States Patent
Washizu

(10) Patent No.: US 6,532,914 B2
(45) Date of Patent: Mar. 18, 2003

(54) INTERNAL COMBUSTION ENGINE

(75) Inventor: Takehiro Washizu, Shizuoka (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/918,980

(22) Filed: Jul. 31, 2001

(65) Prior Publication Data

US 2002/0078908 A1 Jun. 27, 2002

(30) Foreign Application Priority Data

Jun. 9, 2000 (JP) ..... 2000-173971

(51) Int. Cl.[7] ..... F01P 1/08
(52) U.S. Cl. ..... 123/41.41
(58) Field of Search ..... 123/41.41, 41.82, 123/193.5; 60/321

(56) References Cited

U.S. PATENT DOCUMENTS 5,385,125 A * 1/1995 Oyaizu et al. ..... 123/90.27
5,438,754 A 8/1995 Mori
5,606,942 A 3/1997 Tsuzuku et al.
5,758,612 A 6/1998 Tsuzuku et al.
5,778,847 A * 7/1998 Takahashi et al. ..... 123/195 P
5,827,096 A 10/1998 Mineo
5,836,274 A 11/1998 Saito et al.
5,928,044 A 7/1999 Mineo
5,934,958 A 8/1999 Ochiai
6,113,446 A 9/2000 Mineo

* cited by examiner

*Primary Examiner*—Gene Mancene
*Assistant Examiner*—Hyder Ali
(74) *Attorney, Agent, or Firm*—Knobbe Martens Olson & Bear LLP

(57) ABSTRACT

A four-cycle engine includes a cylinder block defining a cylinder bore. A piston is reciprocally disposed within the cylinder bore. A cylinder head member closes an end of the cylinder bore to define a combustion chamber together with the cylinder bore and the piston. The cylinder head member defines an inner passage having a first end communicating with the combustion chamber and a second end terminating at an outer surface of the cylinder head. A valve assembly having a valve section and an actuateable section is provided. The valve section is selectively placed at an open position and a closed position to connect and disconnect the inner passage with the combustion chamber, respectively. The actuateable section is formed oppositely from the valve section. A valve actuation mechanism is arranged to actuate the actuateable section to move the valve section between the open position and the closed position. The cylinder head member further defines a guide opening through which the actuateable section is slideably disposed. An external conduit defines an outer passage communicating with the inner passage. The external conduit depends from an end portion of the cylinder head member. The cylinder head member still further defines a recessed portion between the guide opening and the second end of the inner passage.

11 Claims, 12 Drawing Sheets

INTERNAL COMBUSTION ENGINE

PRIORITY INFORMATION

This application is based on Japanese Application No. 2000-173971, filed Jun. 9, 2000, the entire contents of which is hereby expressly incorporated by reference.

BACKGROUND OF THE INVENTION

1. Field of the Invention

The present invention relates generally to a four-cycle engine, and more particularly to an improved cylinder head for a four-cycle engine.

2. Description of Related Art

Relatively small watercrafts such as, for example, personal watercrafts have become very popular in recent years. This type of watercraft is quite sporting in nature and carries one or more riders. A hull of the watercraft typically defines a rider's area above an engine compartment. An internal combustion engine powers a jet propulsion unit that propels the watercraft by discharging water rearwardly. The engine lies within the engine compartment in front of a tunnel which is formed on an underside of the hull. At least part of the jet propulsion unit is placed within the tunnel and includes an impeller that is driven by the engine.

A four-cycle engine can be used in a personal watercraft. Typical four cycle engines include an exhaust system to discharge exhaust gases from one or more combustion chambers. The engine typically has a cylinder head member in which one or more inner exhaust passages are defined. Typically, one or more exhaust valves are provided to connect or disconnect the inner exhaust passages with the combustion chambers.

A valve actuation mechanism such as, for example, a combination of a camshaft with coil springs, can intermittently actuate the exhaust valves to bring them to an open position and a closed position. When each exhaust valve is in the open position, the associated inner exhaust passage is connected with the corresponding combustion chamber. When the valve is in the closed position, the exhaust passage is disconnected from the combustion chamber.

In some four cycle engines, each exhaust valve has a retainer opposite to a valve head and the coil spring urges the retainer to bring the valve head toward the closed position. The exhaust valve also has a valve lifter placed over the retainer and the camshaft pushes the valve lifter toward the open position. The cylinder head member defines guide openings through which the valve lifters can slide.

In some arrangements, one or more exhaust manifolds can depend from the cylinder head member. The exhaust manifolds define outer exhaust passages communicating with the respective inner exhaust passages to deliver the exhaust gases to a downstream portion of the exhaust system. The exhaust manifolds can be affixed to mount bosses formed on the cylinder head member by, for example, bolts.

SUMMARY OF THE INVENTION

One aspect of the present invention is a discovery that in engines which have exhaust manifolds affixed to mount bosses formed on the cylinder head member, the weight of the exhaust manifolds can deform the guide openings. For example, in some engines, the mount bosses are located adjacent to the guide openings of the valve lifters. It has been found that the weight of the exhaust manifolds deforms the guide openings. With sufficient deformation, movement of the valve lifters within the openings is adversely affected.

A need therefore exists for an improved four-cycle engine that can prevent a guide opening for an exhaust valve assembly from deforming by the weight of an exhaust manifold or conduit depending from a cylinder head member in which the guide opening is defined.

In some configurations of the exhaust manifold for the watercraft, a water jacket is formed through which water flows to cool the exhaust manifold. Another aspect of the invention includes the discovery that such water can be heavy enough to increase the deformation of the guide openings.

Another need thus exists for an improved four-cycle engine for a watercraft that can have an exhaust manifold that ensures a large capacity of a water jacket.

As described above, a four-cycle engine is provided with a valve actuation mechanism. Because the mechanism requires a number of components and members that can increase weight of the engine itself, the cylinder head member preferably is slim, simple and compact.

The engine also is provided with an air induction system to introduce air to the combustion chambers. Intake components such as, for example, a plenum chamber, can depend from the cylinder head member as well as the exhaust manifold. The air induction system also includes one or more intake valves and a valve actuation mechanism that are configured similarly to the exhaust valves and the valve actuation mechanism for the exhaust valves. Guide openings for intake valve lifters also provided in the air induction system, accordingly. It has also been discovered the that weight of the intake components can deform the guide openings for the lifters of the intake valves.

A further need therefore exists for an improved four-cycle engine that can prevent guide openings for valve lifters of either the exhaust or intake valves from deforming even though either exhaust or intake components depend from the cylinder head member.

In accordance with yet another aspect of the present invention, a four-cycle internal combustion engine comprises a cylinder block defining a cylinder bore. A piston is reciprocally disposed within the cylinder bore. A cylinder head member closes an end of the cylinder bore to define a combustion chamber together with the cylinder bore and the piston. The cylinder head member defines an inner passage having a first end communicating with the combustion chamber and a second end terminating at an outer surface of the cylinder head. A valve assembly having a valve section and an actuateable section is provided. The valve section is selectively placed at an open position and a closed position to connect and disconnect the inner passage with the combustion chamber, respectively. The actuateable section is formed oppositely from the valve section. A valve actuation mechanism is arranged to actuate the actuateable section to move the valve section between the open position and the closed position. The cylinder head member further defines a guide opening through which the actuateable section is slideably disposed. An external conduit defines an outer passage communicating with the inner passage. The external conduit depends from an end portion of the cylinder head member. The cylinder head member still further defines a recessed portion between the guide opening and the second end of the inner passage.

In accordance with another aspect of the present invention, an engine includes an engine body. The engine body includes a guide opening and a member slidably mounted within the guide opening. A mounting boss is disposed on an outer surface of the engine body. A recess disposed between the guide opening and the mounting boss.

BRIEF DESCRIPTION OF THE DRAWINGS

These and other features, aspects and advantages of the present invention will now be described with reference to the drawings of a preferred embodiment which is intended to illustrate and not to limit the invention. The drawings comprise 12 figures.

DETAILED DESCRIPTION OF THE PREFERRED EMBODIMENT OF THE INVENTION

Figure 1:
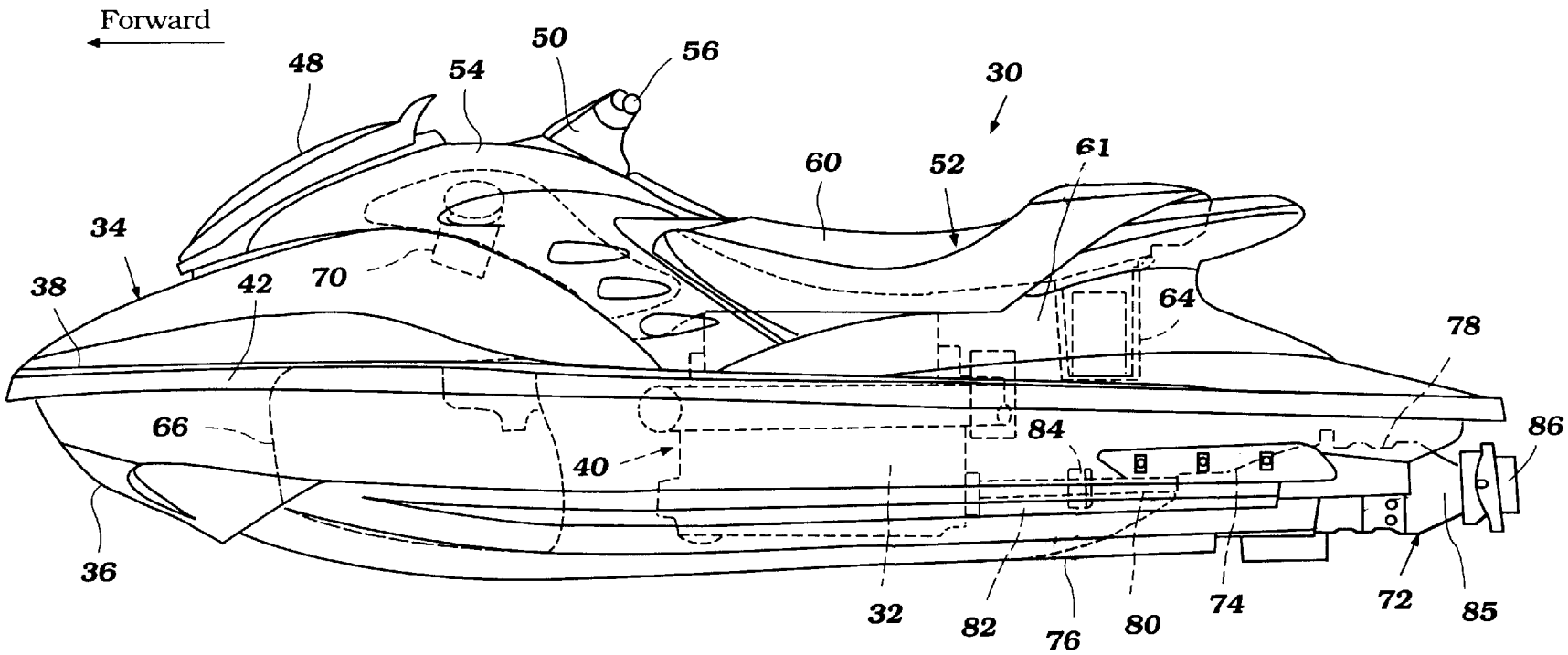
FIG. 1 is a side elevational view of a personal watercraft including a four-cycle engine (show in phantom) configured in accordance with a preferred embodiment of the present invention.
Figure 2:
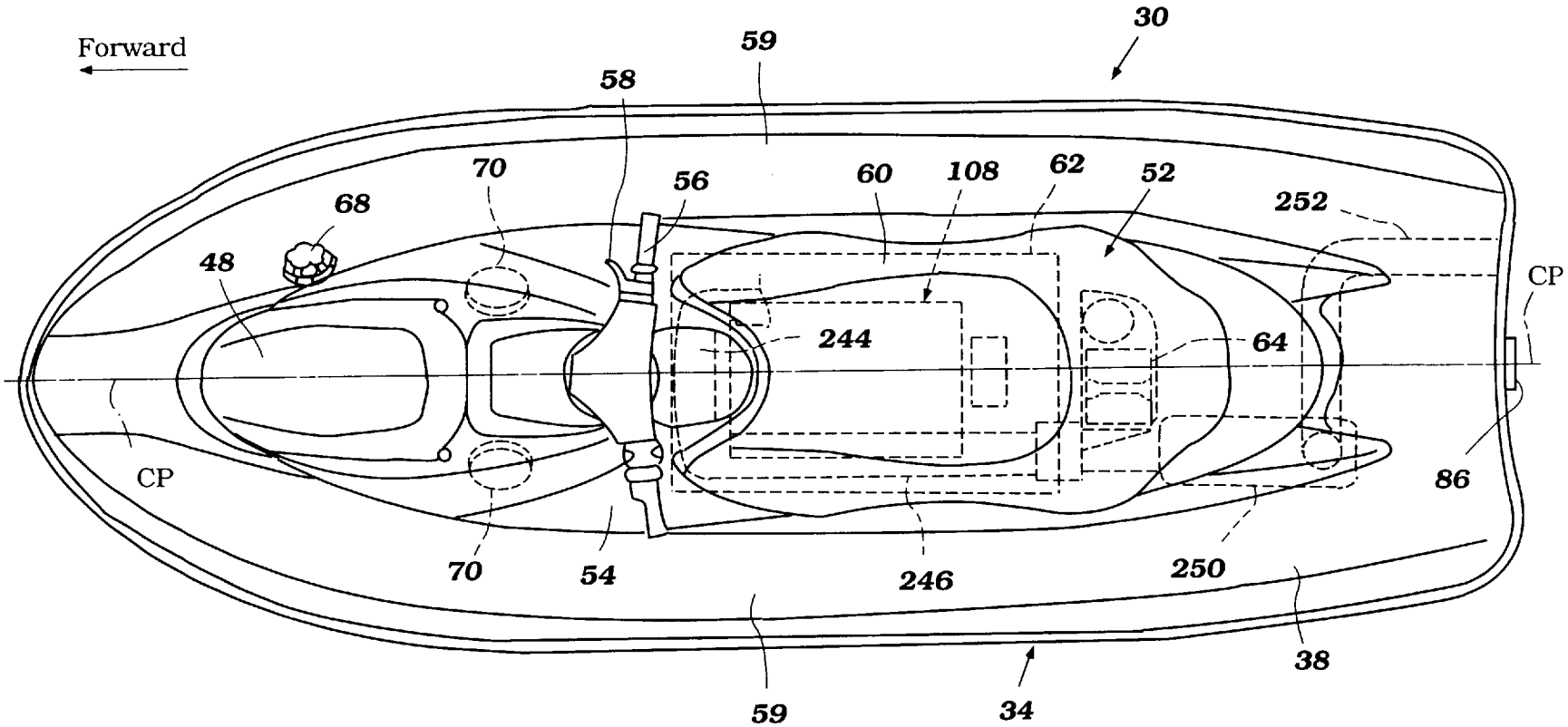
FIG. 2 is a top plan view of the watercraft of FIG. 1.
Figure 3:
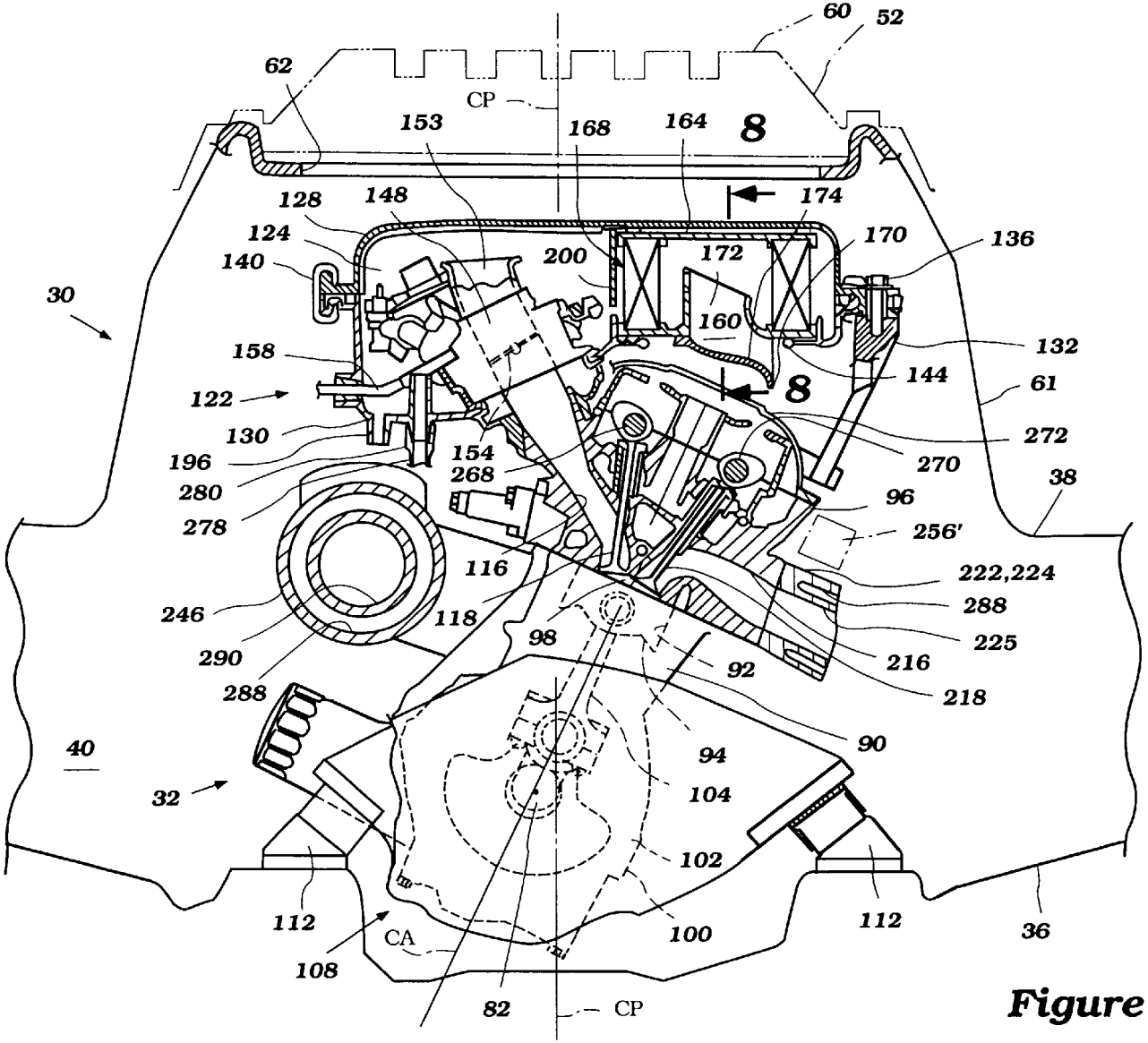
FIG. 3 is a partially sectioned rear view of a hull of the watercraft and the engine disposed within the hull, the engine including a plenum chamber assembly on an upper portion thereof.

With reference to FIGS. 1–3, an overall construction of a personal watercraft 30 that employs an internal combustion engine 32 configured in accordance with the present invention will be described. The engine 32 has particular utility in the context of a marine drive, such as the personal watercraft 30 for instance, and thus is described in the context of a personal watercraft. The engine 32, however, can be used with other types of watercrafts or marine drives (i.e., jet boats, outboard motors, inboard/outboard motors, etc.) and also certain land vehicles, which includes lawnmowers, motorcycles, go carts, all terrain vehicles, automobiles, and the like. Furthermore, the engine 32 can be used as a stationary engine for some applications that will become apparent to those of ordinary skill in the art.

The personal watercraft 30 includes a hull 34 generally formed with a lower hull section 36 and an upper hull section or deck 38. Both the hull sections 36, 38 are made of, for example, a molded fiberglass reinforced resin or a sheet molding compound. The lower hull section 36 and the upper hull section 38 are coupled together to define an internal cavity 40. An intersection of the hull sections 36, 38 is defined in part along an outer surface gunnel or bulwark 42. The hull 36 houses the engine 32 that powers the watercraft 30.

As shown in FIGS. 2 and 3, the hull 34 defines a center plane CP that extends generally vertically from bow to stem with the watercraft 30 resting in normal upright position. Along the center plane CP, the upper hull section 34 includes a hatch cover 48, a steering mast 50 and a seat 52 one after another from fore to aft.

In the illustrated embodiment, a bow portion 54 of the upper hull section 38 slopes upwardly and an opening (not shown) is provided through which a rider can conveniently access a front portion of the internal cavity 40. The bow portion 54 preferably is formed with a pair of separate cover member pieces. The hatch cover 48 is hinged to open or is detachably affixed to the bow portion 54 to cover the opening.

The steering mast 50 extends generally upwardly toward the top of the bow portion 54 to support a handle bar 56. The handle bar 56 is provided primarily to allow a rider to change a thrust direction of the watercraft 30. The handle bar 56 also carries control devices such as, for example, a throttle lever 58 (FIG. 2) for controlling the engine 32.

The seat 52 extends fore to aft along the center plane CP at a location behind the steering mast 50. The seat 52 is configured generally with a saddle shape so that the rider can straddle the seat 52. Foot areas 59 (FIG. 2) are defined on both sides of the seat 52 and on an upper surface of the upper hull section 38. The foot areas 59 are generally flat. However, the foot areas 59 can slope upwardly toward the aft of the watercraft 30.

A seat cushion 60, which has a rigid backing and is supported by a pedestal section 61 of the upper hull section 38, forms a portion of the seat 52. The pedestal section 61 forms the other portion of the seat 52. The seat cushion 60 is detachably affixed to the pedestal section 61. An access opening 62 (FIGS. 2 and 3) is defined on the top surface of the pedestal section 61, under the seat cushion 60, through which the rider can conveniently access a rear portion of the internal cavity 40. The seat cushion 60 usually closes the access opening 62.

The upper hull section 38 also defines a storage box 64 under the seat 52. The entire internal cavity 40 can be an engine compartment for the watercraft 30. Optionally, the watercraft 30 can include one or more bulkheads (not shown) which divide the internal cavity 40 into an engine compartment and at least one other internal compartment (not shown).

A fuel tank 66 is placed in the internal cavity 40 under the bow portion 54 of the upper hull section 38. The fuel tank 66 is coupled with a fuel inlet port (not shown) positioned atop the upper hull section 38 through a proper duct. A closure cap 68 (FIG. 2) closes the fuel inlet port. Optionally, the closure cap 68 can be disposed under the hatch cover 48.

A pair of air ducts or ventilation ducts 70 is provided on both sides of the bow portion 54 so that the ambient air can enter the internal cavity 40 through the ducts 70. Except for the air ducts 70, the internal cavity 40 is substantially sealed to protect the engine 32, a fuel supply system including the fuel tank 66 and other systems or components from water.

The engine 32 preferably is placed within the engine compartment 40 and generally under the seat 52, although other locations are also possible (e.g., beneath the steering mast 50 or in the bow). The rider can access the engine 32 through the access opening 62 by detaching the seat cushion 60 from the pedestal section 61. The engine 32 is described in greater detail below with reference to FIGS. 3–12.

A jet pump assembly 72 propels the watercraft 30. The jet pump assembly 72 is mounted in a tunnel 74 formed on the underside of the lower hull section 36. Optionally, a bulkhead can be disposed between the tunnel 74 and the engine 32. The tunnel 74 has a downward facing inlet port 76 opening toward the body of water. A pump housing 78 is disposed within a portion of the tunnel 74 and communicates with the inlet port 76. An impeller is journaled within the pump housing 78. An impeller shaft 80 extends forwardly from the impeller and is coupled with a crankshaft 82 of the engine 32 by a coupling member 84 which is driven by the crankshaft 82.

A rear end of the pump housing 78 defines a discharge nozzle 85. A deflector or steering nozzle 86 is affixed to the discharge nozzle for pivotal movement about a steering axis which extends generally vertically. A cable connects the deflector 86 with the steering mast 50 so that the rider can steer the deflector 86, and thereby change the direction of travel of the watercraft 30.

When the crankshaft 82 of the engine 32 drives the impeller shaft 80 and thus the impeller, water is drawn from the surrounding body of water through the inlet port 76. The pressure generated in the housing 78 by the impeller produces a jet of water that is discharged through the discharge nozzle 85 and the deflector 86. The water jet thus produces thrust to propel the watercraft 30. The rider can steer the deflector 86 with the handle bar 56 of the steering mast 50 to turn the watercraft 30 in either right or left direction.

With reference to FIG. 3 and additionally with reference to FIGS. 4–11, an overall construction of the engine 32 is described in greater detail below.

The engine 32 operates on a four-cycle combustion principle. The engine 32 comprises a cylinder block 90 that preferably defines four cylinder bores 92 spaced apart from each other from fore to aft along the center plane CP. The engine 32 thus is a L4 (inline four cylinder) type. The illustrated four-cycle engine, however, merely exemplifies one type of engine on which various aspects and features of the present invention can be used. Engines having other number of cylinders including a single cylinder, and having other cylinder arrangements (V and W type) and other cylinder orientations (e.g., upright cylinder banks) are all practicable.

Each cylinder bore 92 has a center axis CA that is slanted with a certain angle from the center plane CP so that the overall height of the engine 32 is shorter. All the center axes CA of the cylinder bores 92 preferably have the same angle relative to the center plane CP.

Pistons 94 are reciprocally disposed within the cylinder bores 92. A cylinder head member 96 is affixed to an upper end portion of the cylinder block 90 to close respective upper ends of the cylinder bores 92 to define combustion chambers 98 with the cylinder bores 92 and the pistons 94.

A crankcase member 100 is affixed to a lower end portion of the cylinder block 90 to close respective lower ends of the cylinder bores 92 and to define a crankcase chamber 102 with the cylinder block 90. The crankshaft 82 is journaled for rotation by at least one bearing formed on the crankcase member 100. Connecting rods 104 couple the crankshaft 82 with the pistons 94 so that the crankshaft 82 rotates with the reciprocal movement of the pistons 94.

The cylinder block 90, the cylinder head member 96 and the crankcase member 100 together define an engine body 108. The engine body 108 preferably is made of aluminum based alloy. In the illustrated embodiment, the engine body 108 is oriented in the engine compartment to position the crankshaft 82 generally parallel to the center plane CP and to extend generally in the longitudinal direction. Other orientations of the engine body 108, of course, also are possible (e.g., with a transverse or vertical oriented crankshaft).

Engine mounts 112 extend from both sides of the engine body 108. The engine mounts 112 preferably include resilient portions made of flexible material, for example, a rubber material. The engine body 108 is mounted on the lower hull section 36, specifically, a hull liner, by the engine mounts 112 so that vibration of the engine 32 is inhibited from transferring to the hull section 36.

The engine 32 preferably comprises an air induction system to introduce air to the combustion chambers 98. The illustrated air induction system includes four inner intake passages 116 defined in the cylinder head member 96. The intake passages 116 communicate with the associated combustion chambers 98 through one or more intake ports. Intake valves 118 are provided at the intake ports to selectively connect and disconnect the intake passages 116 with the combustion chambers 98. In other words, the intake valves 118 move between open and closed positions of the intake ports.

Preferably, the air induction system also includes a plenum chamber assembly or air intake box 122 for smoothing intake air and quieting intake air. The illustrated plenum chamber assembly 122 has a generally rectangular shape in a plan view and defines a plenum chamber 124 therein. Other shapes of the plenum chamber assembly 122 of course are possible, but it is preferable to make the plenum chamber 124 as large as possible within the space provided between the engine body 108 and the seat 52.

Figure 7:
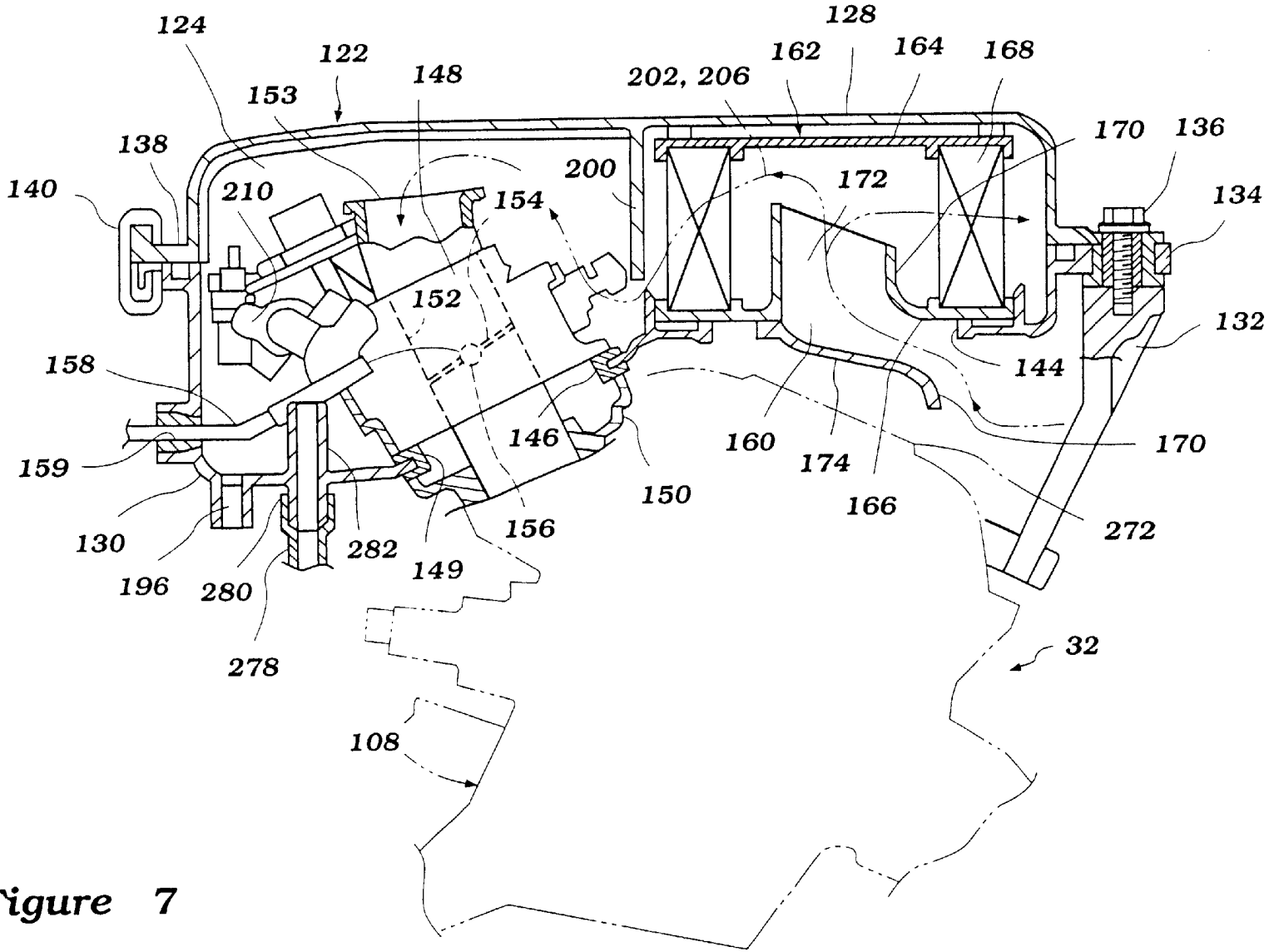
FIG. 7 is an enlarged, partially sectioned rear view of the plenum chamber assembly shown in FIG. 3, the engine body of the engine is shown in phantom line.
Figure 8:
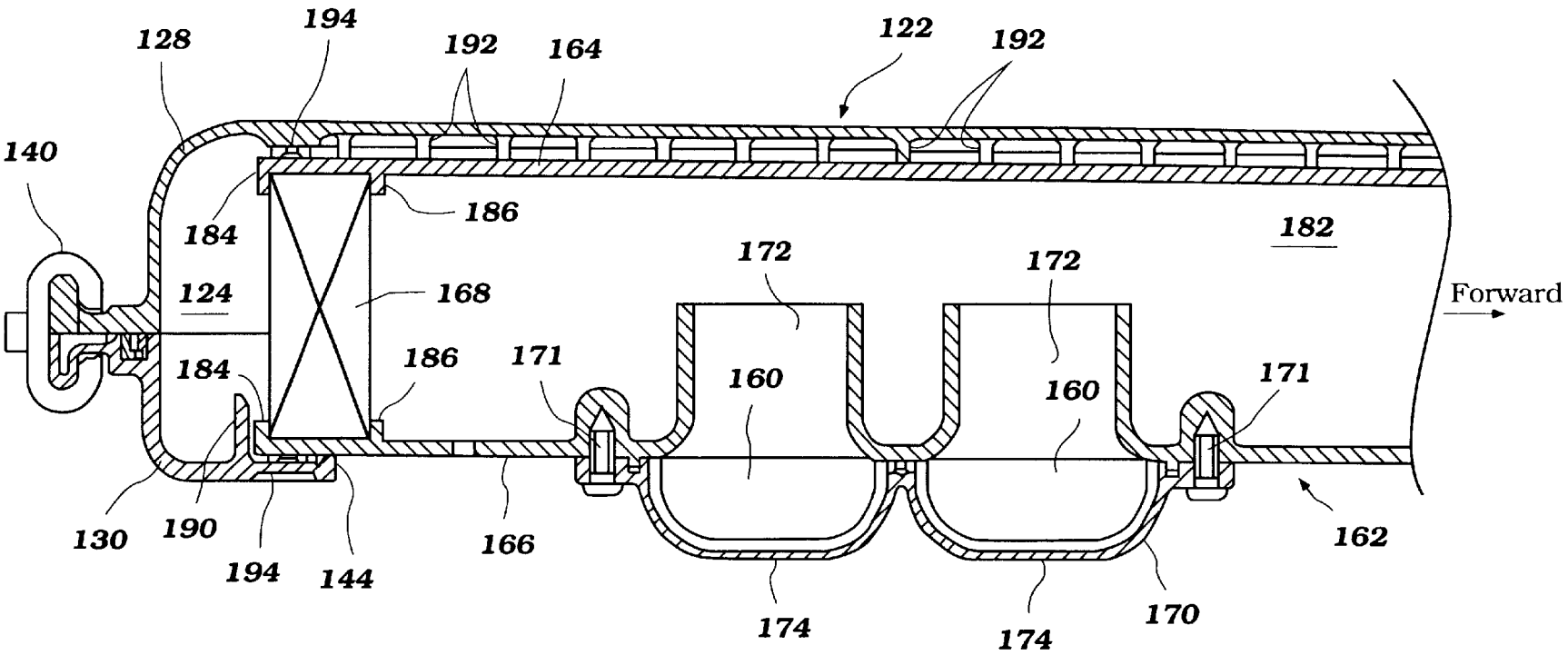
FIG. 8 is an enlarged, partial and sectional side view of the plenum chamber assembly taken along the line 8—8 of FIG. 3.
Figure 9:
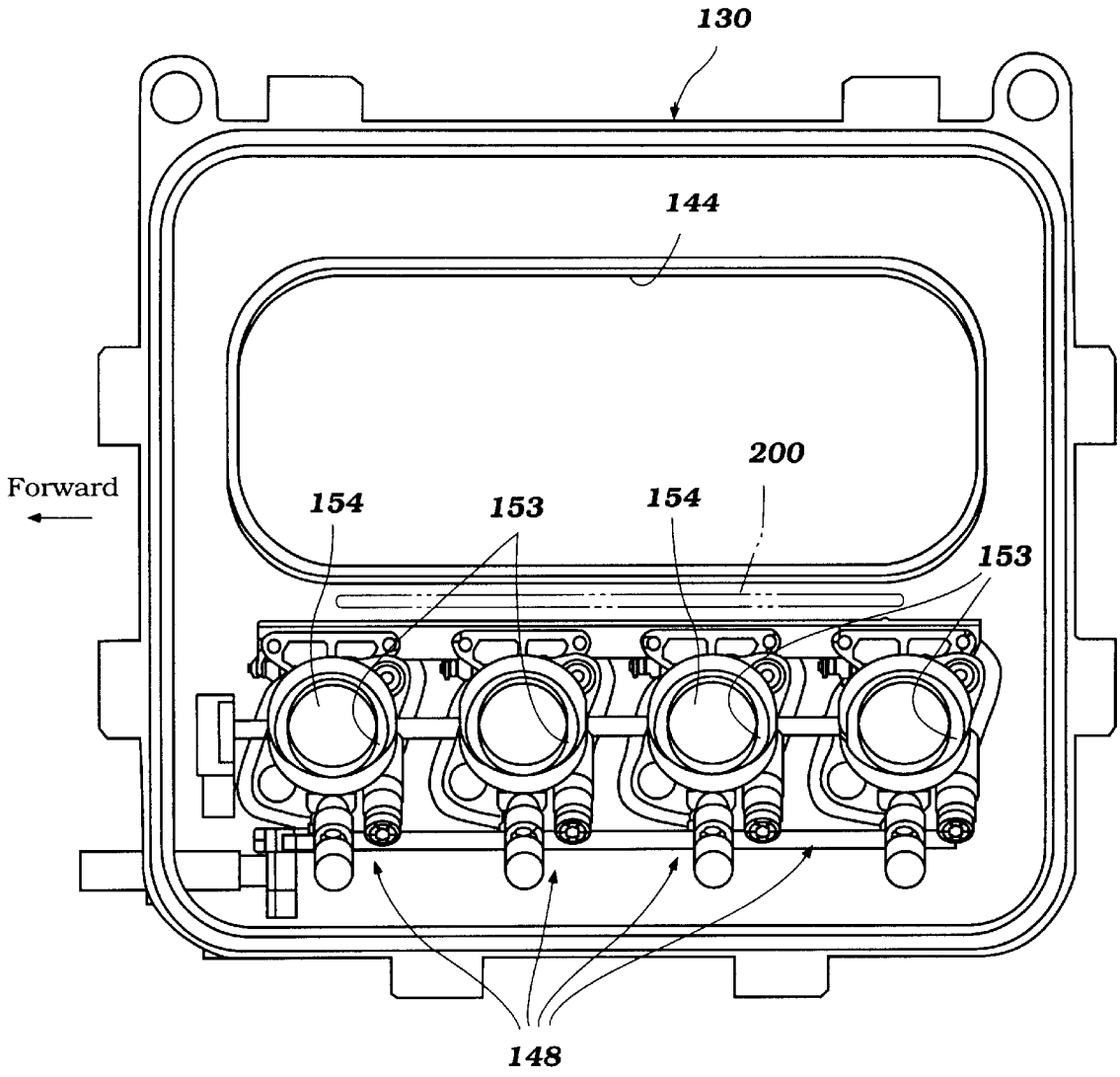
FIG. 9 is a top plan view of a lower chamber member of the plenum chamber assembly shown in FIG. 3. An upper chamber member of the assembly is detached.

As shown in FIGS. 7–9, the plenum chamber assembly 122 comprises an upper chamber member 128 and a lower chamber member 130. The illustrated upper and lower chamber members 128, 130 are made of plastic, although metal or other materials can be used. Optionally, plenum chamber assembly 122 can be formed by only one or a different number of members and/or can have a different assembly orientation (e.g., side-by-side).

The lower chamber member 130 preferably is coupled with the engine body 108. In the illustrated embodiment, several stays 132 extend upwardly from the engine body 108 and a flange portion 134 of the lower chamber member 130 extends generally horizontally. Several fastening members such as, for example, bolts 136 rigidly affix the flange portion 134 to respective top surfaces of the stays 132.

The upper chamber member 128 has a flange portion 138 that abuts on the flange portion 134 of the lower chamber member 130. Several coupling or fastening members 140, which are generally configured as a shape of the letter "C" in section, preferably interpose both the flange portions 134, 138 therebetween so as to couple the upper chamber member 128 with the lower chamber member 130.

As shown in FIGS. 7 and 9, the lower chamber member 130 defines a one large opening 144 and four smaller apertures 146. Preferably, four throttle bodies 148 extend through the apertures 146 and are fixed to the lower chamber member 130 with a seal member 149. The throttle bodies 148 are generally positioned on the port side of the plenum chamber 124.

Respective bottom ends of the throttle bodies 148 are coupled with the associated inner intake passages 116. The throttle bodies 148 preferably extend generally vertically but slant toward the port side oppositely from the center axis CA of the engine body 108. A rubber boot 150 extends between the lower chamber member 130 and the cylinder head member 96 to generally surround lower portions of the throttle bodies 148 which extend out of the plenum chamber 124. The throttle bodies 148 define internal air passages 152 with air inlets 153 opening upwardly within the plenum chamber 124. Air in the plenum chamber 124 thus is drawn to the combustion chambers 98 through the throttle bodies 148 and the inner intake passages 116 when negative pressure is generated in the combustion chambers 98. The negative pressure is generally made when the pistons 94 move toward the bottom dead center from the top dead center.

A throttle valve 154 is journaled for pivotal movement in each internal air passage 152 on a valve shaft 156. The valve shaft 156 links all of the throttle valves 154. The pivotal movement of the valve shaft 156 is controlled by the throttle lever 58 on the handle bar 56 through a control cable 158 that is connected to the valve shaft 156. The control cable 158 can enter the plenum chamber 124 through a through-hole 159 defined at a side surface of the lower chamber member 130. The rider thus can control an opening degree of the throttle valves 154 by operating the throttle lever 56 to obtain various engine speeds. That is, an amount of air passing through the throttle bodies 148 is measured or regulated by this mechanism. Normally, the greater the opening degree, the higher the rate of airflow and the higher the engine speed.

With reference to FIG. 7, air is drawn into the plenum chamber 124 through a pair of air inlet ports 160. In the illustrated embodiment, a filter unit 162 and a guide member 170 together form the inlet ports 160 at the large opening 144 of the lower chamber member 130. The filter unit 162 and the guide member 170 are positioned on the starboard side of the plenum chamber 124 and opposite the throttle bodies 148.

As shown in FIG. 8, the filter unit 162 comprises an upper plate 164, a lower plate 166 and a filter element 168 interposed between the upper and lower plates 164, 166. The guide member 170 is affixed to the lower plate 166 by several screws 171. The lower plate 166 defines a pair of vertical ducts 172 which extend upwardly and inwardly to open toward the plenum chamber 124. The guide member 170 defines a pair of horizontal ducts 174 which extend generally horizontally.

The horizontal ducts 174 are positioned generally above the cylinder head member 96 but open toward the starboard side. Upper ends of the vertical ducts 172 slant slightly toward an inner wall portion of the plenum chamber assembly 122 on the starboard side and opposite from the throttle bodies 148. This is advantageous because water or water mist, if any, is likely to move toward this inner wall portion rather than directly toward the throttle bodies 148.

The filter unit 162 has a generally rectangular shape in a plan view. The filter element 168 extends along an inner periphery of the filter unit 162 and is spaced from the inner peripheral surface so as to maintain a gap between the filter element 168 and the inner peripheral surface. The vertical ducts 170 open to a hollow portion 182 defined within the filter element 168. The air in this hollow portion 182 cannot reach the throttle bodies 148 without passing through the filter element 168. Alien substances in the air thus are removed by the filter element 168 accordingly.

As shown in FIG. 8, in the illustrated embodiment, outer projections 184 and inner projections 186 preferably are formed on respective opposite surfaces of the upper and lower plates 164, 166 to fixedly support the filter element 168 therebetween. While the outer projections 184 extend along the outermost edges of the plates 164, 166, the inner projections 186 extend generally in parallel to the outer projections 184 with a distance slightly larger than the thickness of the filter element 168.

As shown in FIG. 8, the filter unit 162 is fixedly supported by the upper and lower chamber members 128, 130. The lower chamber member 130 has a projection 190 extending toward the upper chamber member 128 and around the large opening 144. This projection 190 prevents the filter unit 162 from slipping off the opening 144.

In addition, as shown in FIG. 8, the upper chamber member 128 has a plurality of ribs 192 extending toward the lower chamber member 130 in parallel to each other. Tip portions of the respective ribs 192 abut on an upper surface of the upper plate 164. Because a distance between the tip portions of the ribs 192 and the lower chamber plate 130 is slightly less than a distance between the upper surface of the upper plate 164 and a lower surface of the lower plate 166, the filter unit 162 can be securely interposed between the upper and lower chamber members 128, 130 when the upper chamber member 164 is affixed to the lower chamber member 130 by the coupling members 140.

A plurality of seal members 194 preferably are positioned at outer periphery portions of the upper and lower plates 164, 166 to be interposed between the respective chamber members 128, 130 and the respective plates 164, 166. Thus, air is allowed to enter the plenum chamber 124 only through the air inlet ports 160. Additionally, a drain port 196 (FIGS. 3 and 7) is formed at a bottom portion of the lower chamber member 130 to drain water in the plenum chamber assembly 122.

Figure 4:
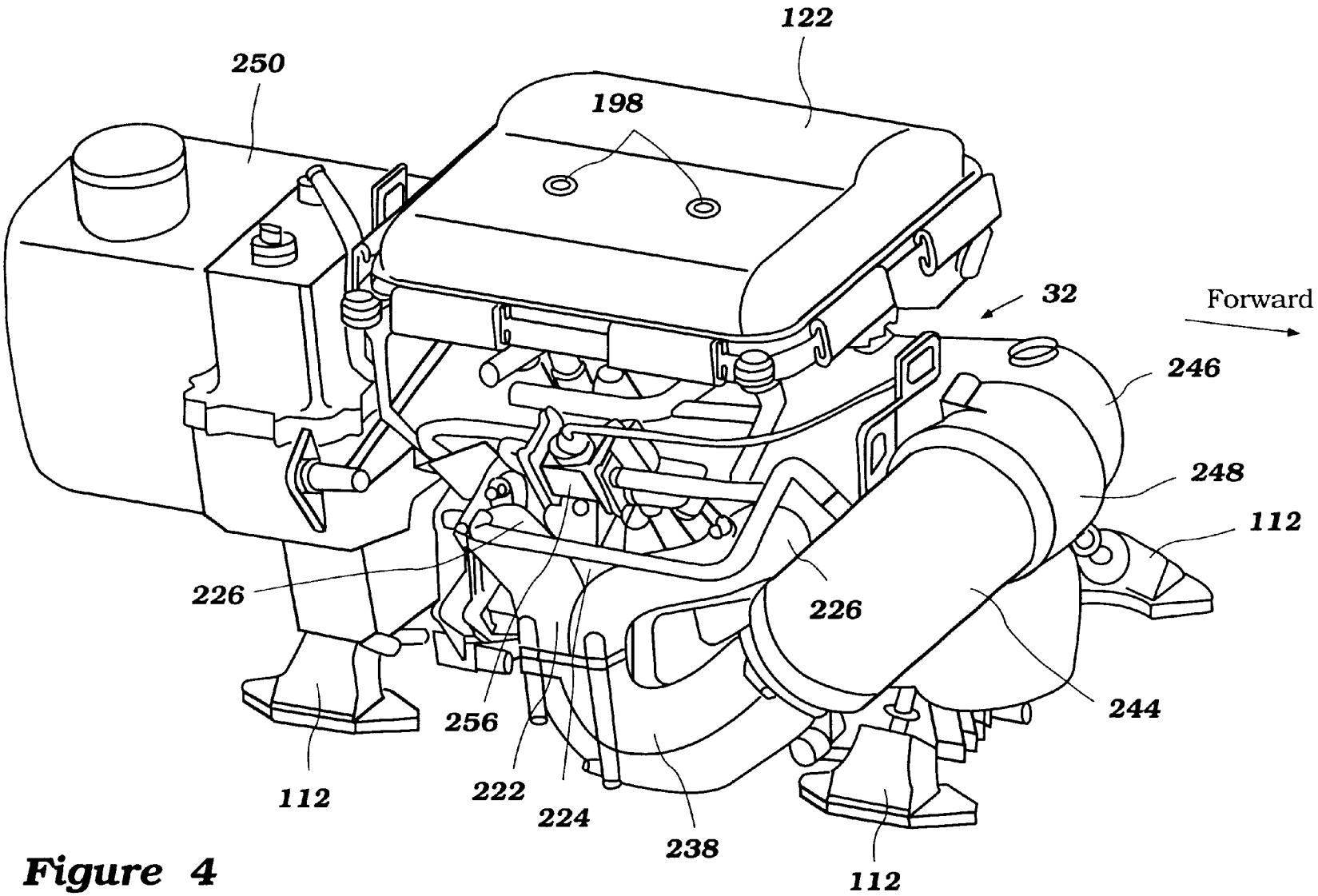
FIG. 4 is a front, top, and starboard side perspective view of the engine shown in FIG. 3.
Figure 5:
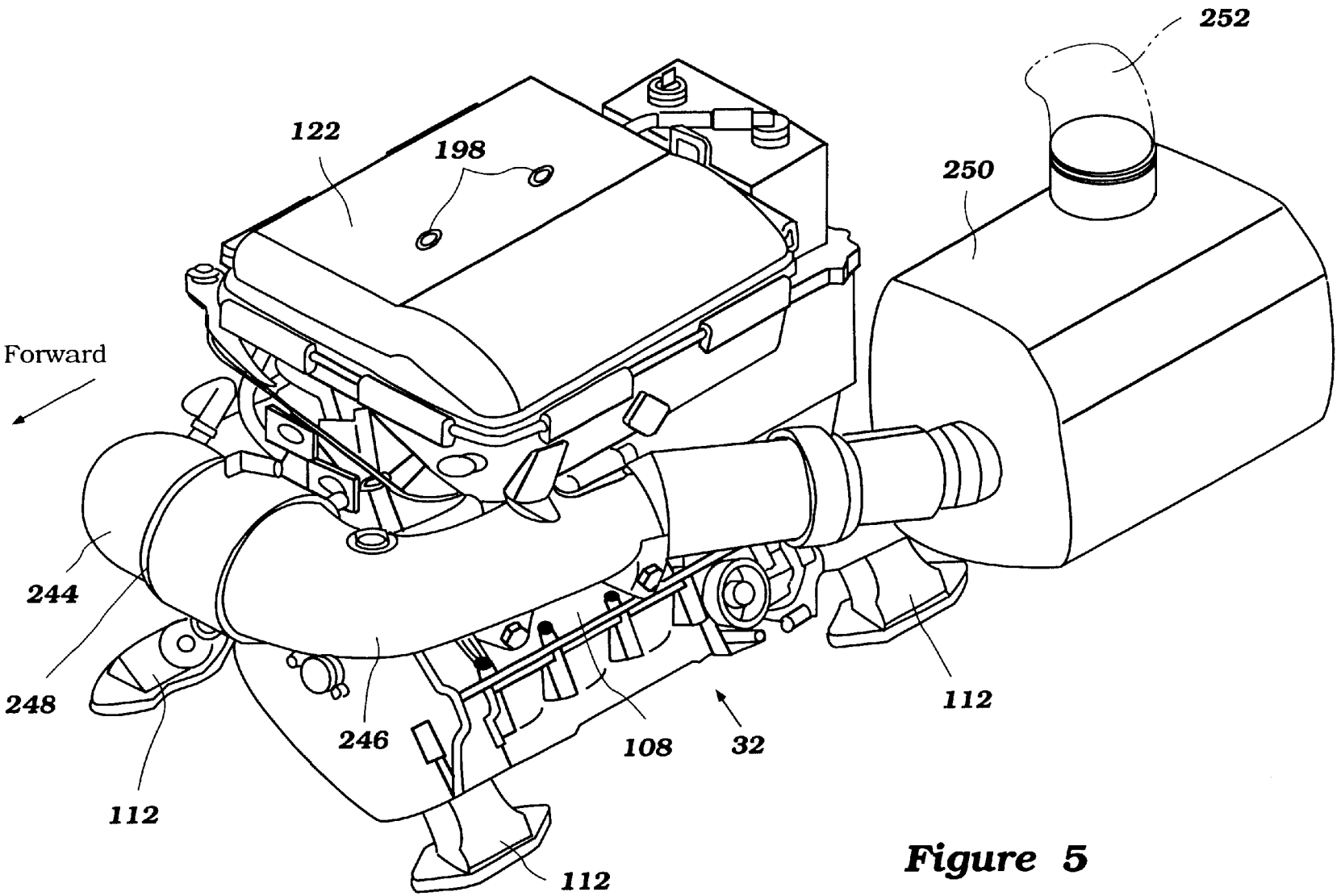
FIG. 5 is a top, front, and port side perspective view of the engine shown in FIG. 3.

As shown in FIGS. 4 and 5, in the illustrated embodiment, the upper chamber member 128 is further fixed to the lower chamber member 130 by a pair of bolts 198. This additional fixing is advantageous not only for the rigid coupling of these chamber members 128, 130 but also for inhibiting noise from occurring by vibration of the upper chamber member 128.

As shown in FIGS. 3, 7, 9 and 10, the illustrated upper chamber member 128 has a baffle portion 200 extending vertically downwardly therefrom and fore to aft generally parallel to the center plane CP . The baffle portion 200 is a thin plate-like projection and is formed generally at a center position of the plenum chamber 124 to divide the chamber 124 into the respective half spaces in which the throttle bodies 148 and the filter unit 162 are disposed, respectively.

Figure 10:
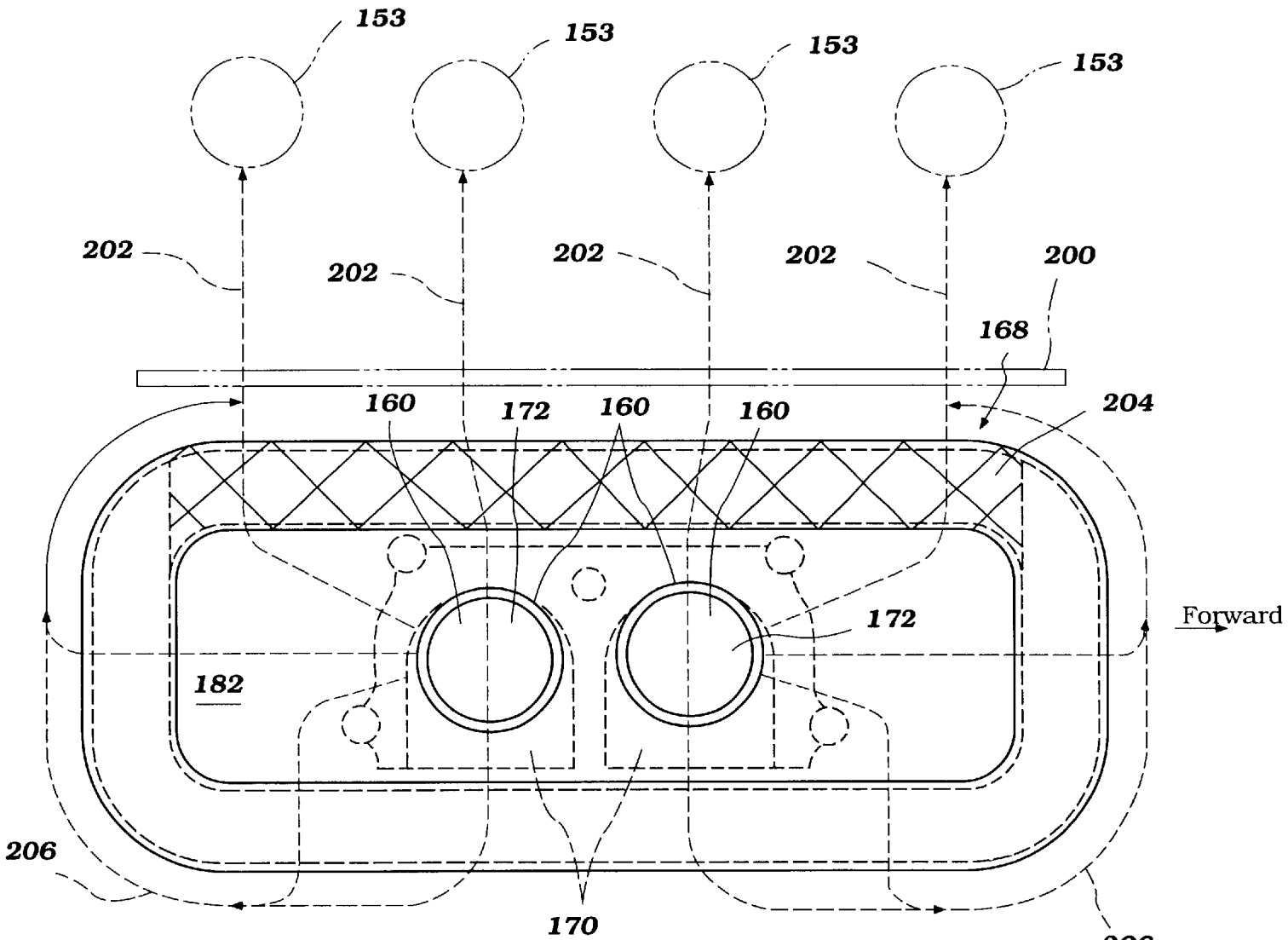
FIG. 10 is a schematical top plan view of the plenum chamber assembly showing a filter unit and a location thereof within the plenum chamber assembly shown in FIG. 3.

In FIG. 10, if this baffle portion 200 is not provided, air in the hollow portion 182 is likely to go to the throttle bodies 148 via a path of least resistance, as schematically indicated by the arrows 202. That is, the air prefers passing through a portion 204 (shown with cross-hatching) of the filter element 168 which is closest to the throttle bodies 148. The baffle portion 200, however, inhibits the air from passing only through the closest portion 204 and rather directs the air to pass generally through the entire body of the filter element 168 as schematically indicated by the arrows 206. This is advantageous because the filter element 168 is more uniformly utilized and hence provides a longer life-span.

Air in the engine compartment 40 enters the hollow portion 182 of the plenum chamber 124 surrounded by the filter element 168 through the inlet ports 160 and passes through the filter element 168. The air then goes to the respective throttle bodies 148 and is drawn into the internal air passages 152 thereof through the air inlets 153. An amount of the air is measured by the throttle valves 154 in the air passages 152.

The engine 32 preferably comprises an indirect or port injected fuel supply system. The fuel supply system includes four fuel injectors 210 (FIG. 7) with one injector allotted to each throttle body 148. The fuel injectors 210 are affixed to a fuel rail (not shown) that is mounted on the throttle bodies 148. The fuel injectors 210 have injection nozzles opening downstream of the throttle valves 156. The fuel injectors 210 spray fuel through the nozzles at certain injection timing and for certain duration under control of an electronic control unit (ECU) (not shown). The sprayed fuel is drawn into the combustion chambers 98 together with the air to form an air/fuel charge therein. It should be noted that a direct fuel injection system that sprays fuel directly into the combustion chambers 98 can replace the indirect fuel injection system described above. Moreover, other charge forming devices such as, for example, carburetors can be used instead of the fuel injection system.

The engine 32 preferably comprises a firing or ignition system. The firing system includes four spark plugs (not shown), one spark plug allotted to each combustion chamber 98. The spark plugs are affixed to the cylinder head member 96 so that electrodes, which are defined at ends of the plugs, are exposed to the respective combustion chambers 98. The spark plugs fire the air/fuel charge in the combustion chambers 98 at an ignition timing under control of the ECU. The air/fuel charge thus is burned within the combustion chambers 98 to move the pistons 92 generally downwardly.

Figure 11:
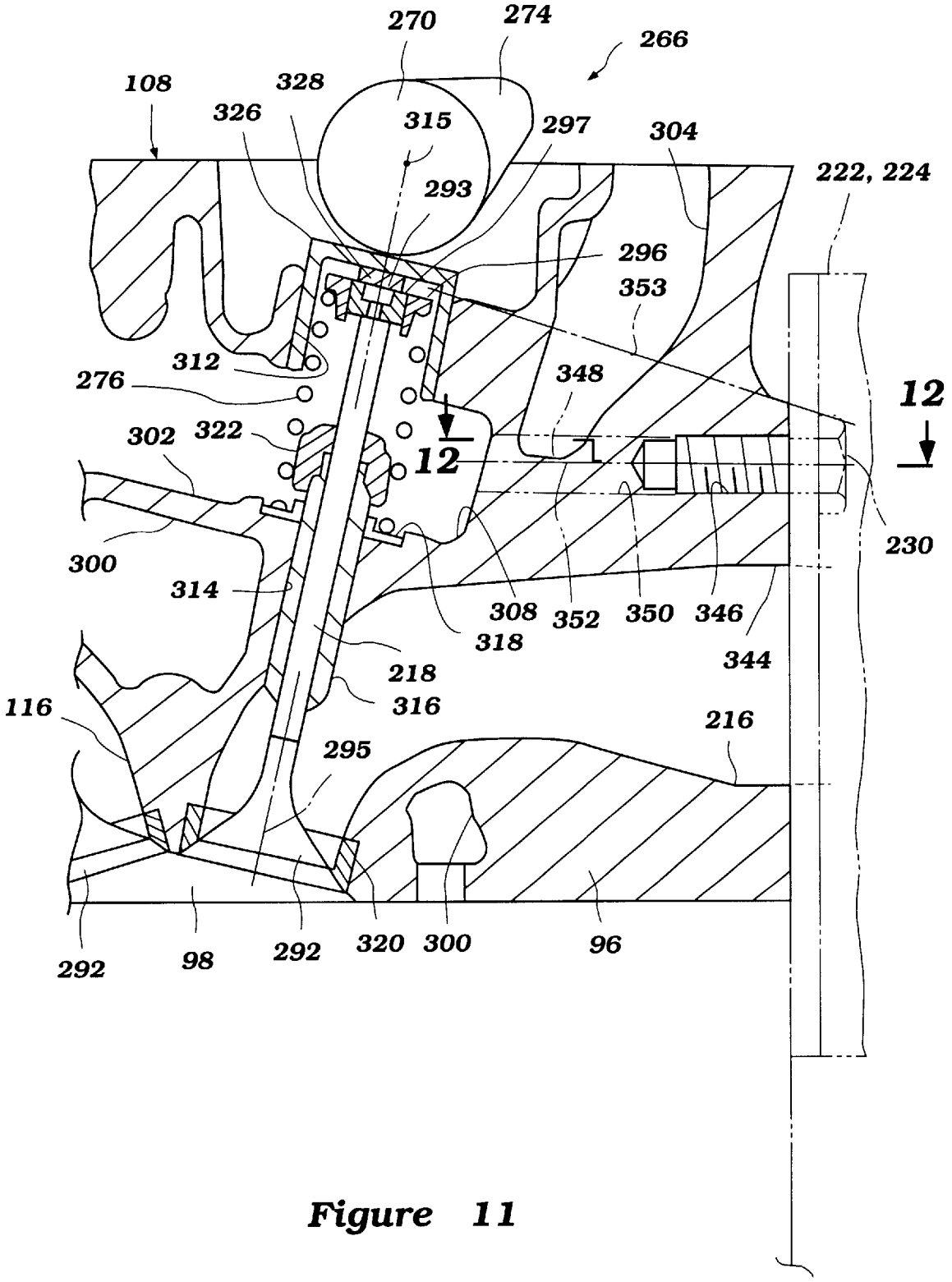
FIG. 11 is an enlarged, partial and sectional rear view of a cylinder head member of the engine shown in FIG. 3.

The engine 32 preferably comprises an exhaust system configured to discharge burnt charges, i.e., exhaust gases, from the combustion chambers 98. In the illustrated embodiment, as shown in FIGS. 3 and 11, the exhaust system includes four inner exhaust passages 216 defined within the cylinder head member 96. The exhaust passages 216 communicate with the associated combustion chambers 98 through one or more exhaust ports. Exhaust valves 218 are provided at the exhaust ports to selectively connect and disconnect the exhaust passages 216 from the combustion chambers 98. In other words, the exhaust valves 218 move between open and closed positions of the exhaust ports.

Figure 6:
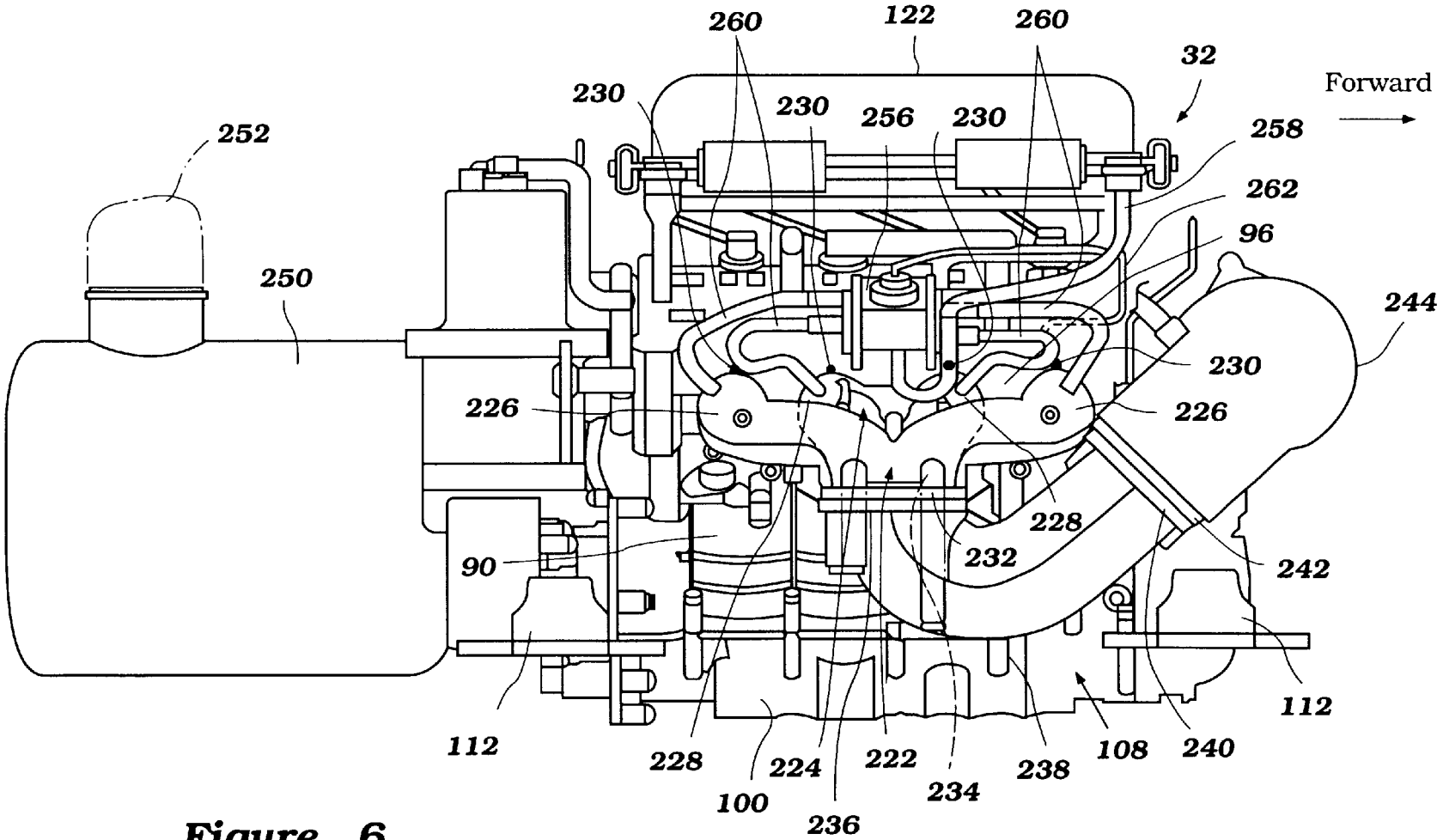
FIG. 6 is a starboard side elevational view of the engine shown in FIG. 3.

As shown in FIGS. 4 and 6, in the illustrated embodiment, first and second exhaust manifolds or exhaust conduits 222, 224 depend from the cylinder head member 96 at a side surface thereof on the starboard side. The exhaust manifolds 222, 224 define outer exhaust passages 225 that are coupled with the inner exhaust passages 216 to collect exhaust gases from the respective inner exhaust passages 216.

The first exhaust manifold 222 has a pair of end portions 226 spaced apart from each other with a length that is equal to a distance between the forward-most exhaust passage 216 and the rear-most exhaust passage 216. The end portions 226 are connected with the forward most and rear-most exhaust passages 216.

The second exhaust manifold 224 also has a pair of end portions 228 spaced apart from each other with a length that is equal to a distance between the other two or in-between exhaust passage 216. The end portions 228 are connected with the in-between exhaust passages 216.

The illustrated exhaust manifolds 222, 224 are affixed to the cylinder head member 96 preferably with ten fasteners such as, for example, bolts. At least four bolts 230 are used to affix the respective end portions 226, 228 of the exhaust manifolds 222, 224 to the cylinder head member 96.

FIG. 6 schematically shows general positions of the bolts 230 indicated by black dots. FIG. 11 shows one of the bolts 230 connecting one of the exhaust manifolds 222, 224 with the cylinder head member 96.

The exhaust manifolds 222, 224 extend slightly downwardly. Respective downstream ends of the first and second exhaust manifolds 232, 234 are coupled with an upstream end 236 of a first unitary exhaust conduit 238. The first unitary conduit 238 extends further downwardly and then upwardly and forwardly in the downstream direction. A downstream end 240 of the first unitary conduit 238 is coupled with an upstream end 242 of a second unitary exhaust conduit 244.

The second unitary conduit 244 extends further upwardly and then transversely to end in front of the engine body 108. As shown in FIGS. 4 and 5, the second unitary conduit 244 is coupled with an exhaust pipe 246 on the front side of the engine body 108. The coupled portions thereof preferably are supported by a front surface of the engine body via a support member 248. The exhaust pipe 246 extends rearwardly along a side surface of the engine body 108 on the port side and then is connected to an exhaust silencer or water-lock 250 at a forward surface of the exhaust silencer 250.

As shown in FIG. 2, the exhaust silencer 250 preferably is placed at a location generally behind and on the port side of the engine body 108. The exhaust silencer 250 is secured to the lower hull 36 or to a hull liner.

A discharge pipe 252 extends from a top surface of the exhaust silencer 250 and transversely across the center plane CP to the starboard side. The discharge pipe 252 then extends rearwardly and opens at the tunnel 74 and thus to the exterior of the watercraft 30 in a submerged position.

The exhaust silencer 250 has one or more expansion chambers to reduce exhaust noise and also inhibits the water in the discharge pipe 244 from entering the exhaust pipe 240 even if the watercraft 30 capsizes as is well known.

As shown in FIGS. 3, 4 and 6, the engine 32 preferably comprises a secondary air supply system comprising a secondary air delivery device 256, an upstream conduit 258 and downstream conduits 260. The secondary air supply system supplies a portion of the air passing through the air induction system to the exhaust system to clean the exhaust gases therein. More specifically, for example, hydro carbon (HC) and carbon monoxide (CO) components of the exhaust gases can be removed by an oxidation reaction with oxygen ($O_2$) that is supplied to the exhaust system through the secondary air supply system.

The secondary air supply device 256 is disposed at a location next to the cylinder head member 96 on the starboard side and is affixed to the engine body 108 by a stay. The upstream conduit 258 connects the plenum chamber 124 with the supply device 256 and the downstream conduits 260 connect the supply device 256 with the respective exhaust manifolds 222, 224.

The air supply device 252 defines a closed cavity therein and contains a control valve. In addition, a negative pressure delivery pipe 262 extends from a top portion of the supply device 256 to one of the inner intake passages 116 to introduce a negative pressure generated therein. The control valve controls whether to allow the air from the upstream conduit 258 to flow toward the downstream conduits 260 in response to the negative pressure. If the negative pressure is greater than a preset negative pressure, the control valve permits the air to flow to the downstream conduits 260. Meanwhile, when the negative pressure is less than the preset negative pressure, the control valve inhibits the air from flowing to the downstream conduits 260. The exhaust gas purification functions under a relatively high speed and/or high load condition because the hydrocarbon (HC) and carbon monoxide (CO) are likely to be produced greater in the exhaust gases under such a conditions.

As shown in FIGS. 3 and 11, the engine 32 has a valve actuation mechanism 266 for actuating the intake and exhaust valves 118, 218. In the illustrated embodiment, the valve actuation mechanism 266 comprises a double overhead camshaft drive including an intake camshaft 268 and an exhaust camshaft 270. The intake and exhaust camshafts 268, 270 actuate the intake and exhaust valves 118, 218, respectively. The intake camshaft 260 extends generally horizontally over the intake valves 118 from fore to aft in parallel to the center plane CP, while the exhaust camshaft 270 extends generally horizontally over the exhaust valves 218 from fore to aft also in parallel to the center plane CP. Both the intake and exhaust camshafts 268, 270 are journaled for rotation by the cylinder head member 96 with a plurality of camshaft caps. The camshaft caps holding the camshafts 268, 270 are affixed to the cylinder head member 96. A cylinder head cover member 272 extends over the camshafts 268, 270 and the camshaft caps, and is affixed to the cylinder head member 96 to define a camshaft chamber. The foregoing stays 132 and the secondary air supply device 252 preferably are affixed to the cylinder head cover member.

The intake camshaft 268 has cam lobes, each associated with each one of the intake valves 118. The exhaust camshaft 270 has also cam lobes 274 (FIG. 11) each associated with each one of the exhaust valves 218. The intake and exhaust valves 118, 218 normally close the intake and exhaust ports by biasing force of springs 276 (FIG. 11). When the intake and exhaust camshafts 268, 270 rotate, the respective cam lobes push the associated valves 118, 218 to open the respective ports against the biasing force of the springs 276. The air thus can enter the combustion chambers 98 at every opening timing of the intake valves 118 and the exhaust gases can move out from the combustion chambers 98 at every opening timing of the exhaust valves 218. The crankshaft 82 preferably drives the intake and exhaust camshafts 268, 270.

Preferably, the respective camshafts 268, 270 have driven sprockets affixed to ends thereof. The crankshaft 82 also has a drive sprocket. Each driven sprocket has a diameter which is twice as large as a diameter of the drive sprocket. A timing chain or belt is wound around the drive and driven sprockets. When the crankshaft 82 rotates, the drive sprocket drives the driven sprockets via the timing chain, and then the intake and exhaust camshafts 268, 270 rotate also. The rotational speed of the camshafts 268, 270 are reduced to half of the rotational speed of the crankshaft 82 because of the differences in diameters of the drive and driven sprockets.

A further construction of the exhaust valves 218, a circumferential structure around the exhaust valves 218 and a portion of the valve actuation mechanism 266 for the exhaust valves 218 is described in greater detail below with reference to FIGS. 11 and 12.

Ambient air enters the engine compartment 40 defined in the hull 34 through the air ducts 70. The air is introduced into the plenum chamber 124 defined by the plenum chamber assembly 122 through the air inlet ports 160 and then drawn into the throttle bodies 148. The air cleaner element 168 cleans the air. The majority of the air in the plenum chamber 124 is supplied to the combustion chambers 98. The throttle valves 154 in the throttle bodies 148 regulate an amount of the air toward the combustion chambers 98. Changing the opening degrees of the throttle valves 154 that are controlled by the rider with the throttle lever 58 regulates the airflow across the valves. The air flows into the combustion chambers 98 when the intake valves 118 are opened. At the same time, the fuel injectors 210 spray fuel into the intake ports under the control of ECU. Air/fuel charges are thus formed and are delivered to the combustion chambers 98.

The air/fuel charges are fired by the spark plugs also under the control of the ECU. The burnt charges, i.e., exhaust gases, are discharged to the body of water surrounding the watercraft 30 through the exhaust system. A relatively small amount of the air in the plenum chamber 124 is supplied to the exhaust system 224 through the secondary air supply system to purify the exhaust gases. The burning of the air/fuel charges makes the pistons 94 reciprocate within the cylinder bores 92 to rotate the crankshaft 82.

The engine 32 preferably includes a lubrication system that delivers lubricant oil to engine portions for inhibiting frictional wear of such portions. In the illustrated embodiment, a closed-loop type, dry-sump lubrication system is employed. Lubricant oil for the lubrication system preferably is stored within the crank chamber 102 at its bottom and an oil pump is provided within a circulation loop to deliver the oil in the reservoir to the engine portions that need lubrication. The oil then returns to the reservoir by its own weight.

The engine 32 also preferably includes a blow-by gas and oil mist collection system. Although several piston rings disposed around the respective pistons 94 inhibit the air/fuel charges from leaking to the crankcase chamber 102 from the combustion chambers 98, a portion of the charges can nevertheless pass through a space defined between the piston rings and the cylinder bores 92 due to the large pressure in the combustion chambers 98. The air/fuel charges that have leaked from the combustion chambers 98 form blow-by gases and drift in the crankcase chamber 102. In addition, the lubricant oil in the crankcase chamber 102 can form oil mists due to rapid rotation of the crankshaft 82 and the oil mists also drift within the crankcase chamber 102. Other engine portions which are supplied with the lubricant may also produce oil mists and/or gaseous components. The blow-by gas and oil mist collection system thus collects such gases and oil mists, separates liquid components from gaseous components and then sends the separated liquid components to the lubrication system and also sends the gaseous components to the air induction system. A blow-by gas conduit 278 (FIGS. 3 and 7) is coupled with a blow-by gas inlet port 280 formed at the bottom of the plenum chamber assembly 122 in proximity to the drain port 196. The illustrated blow-by gas inlet port 280 has a portion 282 extending upwardly within the plenum chamber 124. The gaseous components are drawn into the throttle bodies 148 toward the combustion chambers 98 and then are burned in the combustion chambers 98 with the air/fuel charges.

The watercraft 30 preferably employs a cooling system for the engine 32 and the exhaust system. Preferably, the cooling system is an open-loop type and includes a water pump and a plurality of water jackets and/or conduits. In the illustrated embodiment, the jet pump assembly 72 is used as the water pump with a portion of the water pressurized by the impeller being drawn off for the cooling system, as known in the art.

The engine body 108 and the respective exhaust conduits 222, 224, 238, 244, 246 define the water jackets. Both portions of the water to the water jackets of the engine body 108 and to the water jackets of the exhaust system can flow through either common channels or separate channels formed within one or more exhaust conduits 222, 224, 238, 244, 246 or external water pipes. The illustrated exhaust conduits 222, 224, 238, 244, 246 preferably are formed as dual passage structures in general. More specifically, as exemplarily shown in FIG. 3 with the exhaust manifolds 222, 224 and the exhaust pipe 246, water jackets 288 are defined around the outer exhaust passages 225 thereof. A construction of the water passages of the exhaust system is disclosed in a co-pending U.S. application filed Jan. 17, 2001, titled ENGINE FOR WATERCRAFT, which Ser. No. is 09/765,052, the entire contents of which is hereby expressly incorporated by reference.

Figure 12:
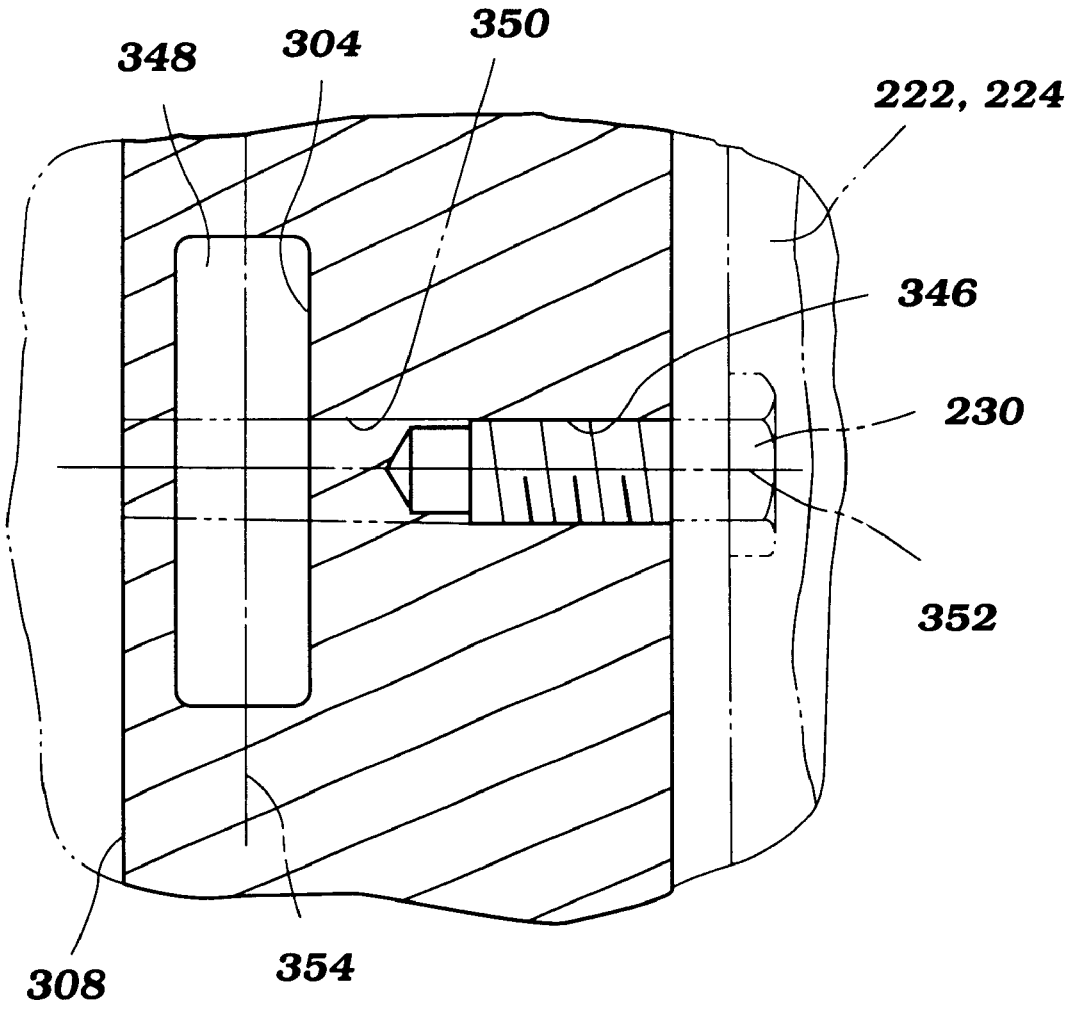
FIG. 12 is a partial and sectional top plan view of the cylinder head member taken along the line 12—12 of FIG. 11.

With reference to FIGS. 11 and 12, a construction of the exhaust valves 218, a construction of a portion of the valve actuation mechanism 266 for one of the exhaust valves 218 and a circumferential construction around the exhaust valve 218 is described in greater detail below. It should be noted that other constructions of the exhaust valves 218, other constructions of the valve actuation mechanism 266 for other exhaust valves 218 and circumferential constructions around other exhaust valves 218 are substantially the same as those described below. In addition, corresponding constructions for the air induction system are similar to those for the exhaust system described below also.

With reference to FIGS. 11 and 12, the exhaust valve 218 comprises a valve head 292, a tip or end portion 293 and a stem 294 connecting the valve head 292 with the tip portion 293. A valve axis 295 extends through the stem from the valve head portion 292 to the tip portion 293. The tip portion 293 is provided with a spring retainer 296 via a cotter 297.

The cylinder head member 96 defines a water jacket 300 for the cooling system and an oil collection passage 302 for the blow-by gas and oil-mist collection system. The oil collection passage 302 preferably is connected to the crankcase chamber 102 and also to the plenum chamber 124 through the blow-by gas conduit 278. The water jacket 300 and the oil collection passage 302 themselves advantageously contribute to decrease the weight of the cylinder head member 96 because they give relief of the thickness. However, the number of components of the valve actuation mechanism 226 increases the weight of the engine itself. Thus, the cylinder head member 96 of the four-cycle engine 32 is required to be as slim, simple, compact, and light as possible. Additionally, therefore, the illustrated cylinder head member 96 defines a number of thickness relief recesses such as, for example, a recess 304 formed next to the cylinder head cover member 272 to further decrease the weight thereof. A recess 308 defined at an end of the oil collection passage 302 forms a pathway that connects all the oil collection passages 302 of the respective cylinders with each other. The recess 308 is also useful in reduction of the weight of the cylinder head member 96.

The cylinder head member 96 further defines an upper guide opening 312 and a lower guide opening 314 through which the exhaust valve 218 extends. The upper guide opening 312 has an inner diameter greater than an inner diameter of the lower guide opening 314. The upper and lower guide openings 312, 314 have a common axis and the exhaust valve 218 is inserted into both the guide openings 312, 314 so that the valve axis 295 is coincident with the common axis of the guide openings 312, 314. The valve axis 295, i.e., the common axis of the guide openings 312, 314, intersects a camshaft axis 315. The valve axis 295 also intersects the oil collection passage 302 in the illustrated arrangement.

A valve guide 316 is rigidly fitted into the lower guide opening 314 to slideably support the stem 294 of the exhaust valve 218. A spring seat 318 is placed around the valve guide 316 and at the bottom of the oil collection passage 302. The spring 276 for the exhaust valve 218, which preferably is a coil spring, is provided between the valve seat 318 and the retainer 296 to urge the valve 218 toward the exhaust camshaft 270.

Under this condition, the valve head 292 is placed in the closed position of the exhaust port to disconnect the exhaust passage 216 from the combustion chamber 98. The exhaust port in this embodiment is formed with a valve seat member 320 embedded in the cylinder head member 96 at an end portion of the inner exhaust passage 320 facing the combustion chamber 98.

A stem seal 322 is fitted around the stem 314 and is fixed atop the valve guide 316 to inhibit the oil components in the oil collection passage 302 from leaking to the combustion chamber 98 through a gap formed between an outer surface of the stem 294 and an inner surface of the valve guide and further the inner exhaust passage 216.

A valve lifter 326, which is formed generally as a cylindrical configuration and is made of iron material, is inserted into the upper guide opening 312 to be placed atop the tip portion 293 of the exhaust valve 218 via a pad 328. The valve lifter 326 has an outer diameter generally equal to an inner diameter of the upper guide opening 312 and is slideable within the upper guide opening 312. A center axis of the valve lifter 326 is consistent with the valve axis 295. The precision of the inner diameter of the upper guide opening 276 ensures a smooth motion of the valve lifter 326 within the guide opening 276.

A top surface of the valve lifter 326 abuts on the exhaust camshaft 270 under the bias of the coil spring 276 which urges the valve lifter 326 toward the camshaft 270 via the retainer 296 and the pad 328. The exhaust valve 218 is also lifted via the cotter 297 and the retainer 296 to close the exhaust port with the valve head 292. By contacting the top surface of the valve lifter 326, the cam lobe 274 pushes the valve lifter 326 downward against the biasing force of the coil spring 276 and hence the valve head 292 moves to open the exhaust port.

In the illustrated embodiment, the exhaust valve 218 and the peripheral members and/or components such as, for example, the cotter 297, the retainer 296, the pad 328 and the valve lifter 326, that are either rigidly or not rigidly coupled with the valve 218 to move in unison together, define an exhaust valve assembly. Also, at least the tip portion 293 of the valve 218, the cotter 297, the retainer 296, the pad 328 and the valve lifter 326 together define an actuateable section of the valve assembly in this embodiment. In addition, at least the valve head 292 solely defines a valve section of the valve assembly in this embodiment.

As described above, the exhaust manifolds 222, 224 depend from the cylinder head member 96 at the side surface thereof. Bolts 230 are used to affix the exhaust manifolds 222, 224 to the cylinder head member 96. Because the cylinder head member 96 defines a number of recesses or hollows such as, for example, the inner exhaust passages 216, the water jackets 300, the oil collection passages 302 and the thickness relief recess 304, only limited locations remain for mount bosses 344 where bolt holes 346 of the bolts 230 are formed. That is, the locations can be close proximity to the upper guide openings 312.

It has been found that the weight of the exhaust manifolds 222, 224, which comprises the weight of the manifolds 222, 224 and the weight of water in the water jackets 288 (FIG. 3), can exert downward force onto the upper guide openings 312 to deform them. More specifically, the inner diameters of the upper guide openings 312 can be distorted such that its diameter is changed, thus preventing the valve lifters 326 from sliding smoothly within the guide openings 312.

The illustrated recesses 304 preferably have portions 348 that intersect imaginary cylindrical projections 350 that extend along the respective axes 352 of the bolt holes 346. As shown in FIG. 12, each one of the portions 348 preferably is formed as a slot which has an axis 354 that extends normal to the axis 352 of the bolt hole 346 and generally parallel to the connecting recess 308 of the oil collection passages 302. The recesses 304 can divide the mount bosses 344 from the upper guide openings 312. As such, the mount bosses 344 can bend without exerting a force sufficient to distort the upper guide openings 312.

The recesses 304 are not necessarily provided with the deepest portions 348 extending across the imaginary cylindrical portions 350. The recesses 304, however, desirably have portions deeper than a plane that extends generally horizontally to include the phantom line 353 as indicated in FIG. 11 so that the recesses 304 are disposed between the bolts 230 and the upper guide openings 312. The plane indicated by the phantom line 353 passes at the top ends of the upper guide openings 312 and the top ends of the mount bosses 344.

It should be noted that recesses such as the recesses 304 can be applied to the intake valve side of the cylinder head member 96 as well if the engine employs intake components that depends from the cylinder head member on the intake valve side.

Additionally, the water jackets are not necessarily formed within the exhaust manifolds.

However, the described construction is more effective with the exhaust manifolds having water jackets because the exhaust manifolds can have larger capacities for the water jackets with the construction. In addition, thickness relief recesses are not necessarily formed within the cylinder head member. Further, the deepest portions can have any configuration other than the slots and can extend in any directions or any angles relative to, for example, the bolt holes. Furthermore, the upper guide openings and the bolt holes are not necessarily disposed on a same vertical plane. That is, both of them can be offset from one another in a direction of the crankshaft.

Of course, the foregoing description is that of a preferred construction having certain features, aspects and advantages in accordance with the present invention. Various changes and modifications may be made to the above-described arrangements without departing from the spirit and scope of the invention, as defined by the appended claims.

What is claimed is:

1. A four-cycle internal combustion engine comprising a cylinder block defining a cylinder bore, a piston reciprocally disposed within the cylinder bore, a cylinder head member closing an end of the cylinder bore to define a combustion chamber together with the cylinder bore and the piston, the cylinder head member defining an inner passage having a first end communicating with the combustion chamber and a second end opening at an exterior surface of the cylinder head member, a valve assembly having a valve section and an actuateable section, the valve section selectively placed at an open position and a closed position to connect and disconnect the inner passage with the combustion chamber, respectively, the actuateable section being formed oppositely from the valve section, a valve actuation mechanism arranged to actuate the actuateable section to move the valve section between the open position and the closed position, the cylinder head member further defining a guide opening through which the actuateable section is slideably disposed, and an external conduit defining an outer passage communicating with the inner passage, the external conduit depending from an end portion of the cylinder head member, the cylinder head member defining a recessed portion disposed between the guide opening and the second end of the inner passage, wherein the inner passage, the valve assembly and the external conduit are an exhaust inner passage, an exhaust valve assembly and an exhaust conduit, respectively, and together define an exhaust system through which exhaust gases are discharged from the combustion chamber, additionally comprising a fastener to affixing the external conduit to the cylinder head member, wherein the second end of the inner passage forms a mounting boss, and the fastener is connected to the mounting boss, wherein the fastener includes a bolt, the mounting boss defines a bolt hole into which the bolt is fitted, and an imaginary cylindrical portion extending straight along an axis of the bolt hole toward the valve assembly from the bolt hole intersects, at least in part, the recessed portion.

2. The four-cycle engine as set forth in claim 1, wherein the recessed portion is generally configured as a slot extending generally normal to the axis of the bolt hole.

3. A four-cycle internal combustion engine comprising a cylinder block defining a cylinder bore, a piston reciprocally disposed within the cylinder bore, a cylinder head member closing an end of the cylinder bore to define a combustion chamber together with the cylinder bore and the piston, the cylinder head member defining an inner passage having a first end communicating with the combustion chamber and a second end opening at an exterior surface of the cylinder head member, a valve assembly having a valve section and an actuateable section, the valve section selectively placed at an open position and a closed position to connect and disconnect the inner passage with the combustion chamber, respectively, the actuateable section being formed oppositely from the valve section, a valve actuation mechanism arranged to actuate the actuateable section to move the valve section between the open position and the closed position, the cylinder head member further defining a guide opening through which the actuateable section is slideably disposed, and an external conduit defining an outer passage communicating with the inner passage, the external conduit depending from an end portion of the cylinder head member, the cylinder head member defining a recessed portion disposed between the guide opening and the second end of the inner passage, wherein the inner passage, the valve assembly and the external conduit are an exhaust inner passage, an exhaust valve assembly and an exhaust conduit, respectively, and together define an exhaust system through which exhaust gases are discharged from the combustion chamber, wherein the exhaust conduit defines a coolant jacket through which coolant flows to cool the exhaust conduit.

4. The four-cycle engine as set forth in claim 3, wherein the engine powers a marine propulsion device.

5. A four-cycle internal combustion engine comprising a cylinder block defining a cylinder bore, a piston reciprocally disposed within the cylinder bore, a cylinder head member closing an end of the cylinder bore to define a combustion chamber together with the cylinder bore and the piston, the cylinder head member defining an inner passage having a first end communicating with the combustion chamber and a second end opening at an exterior surface of the cylinder head member, a valve assembly having a valve section and an actuateable section, the valve section selectively placed at an open position and a closed position to connect and disconnect the inner passage with the combustion chamber, respectively, the actuateable section being formed oppositely from the valve section, a valve actuation mechanism arranged to actuate the actuateable section to move the valve section between the open position and the closed position, the cylinder head member further defining a guide opening through which the actuateable section is slideably disposed, and an external conduit defining an outer passage communicating with the inner passage, the external conduit depending from an end portion of the cylinder head member, the cylinder head member defining a recessed portion disposed between the guide opening and the second end of the inner passage, wherein the recessed portion is generally configured as a slot.

6. An engine comprising an engine body, a guide opening, a member slidably mounted within the guide opening, a mounting boss disposed on an outer surface of the engine body configured to at least partially support a device exterior to the engine body, and a recess disposed between the guide opening and the mounting boss, wherein the device is an exhaust manifold, additionally comprising an exhaust passage extending from the exhaust manifold to the atmosphere, wherein the exhaust manifold includes a water jacket.

7. An engine comprising an engine body, a guide opening, a member slidably mounted within the guide opening, a mounting boss disposed on an outer surface of the engine body configured to at least partially support a device exterior to the engine body, and a recess disposed between the guide opening and the mounting boss, wherein the device is an exhaust manifold, additionally comprising a fastener connecting the device to the mounting boss, the recess being defined between the fastener and the guide opening.

8. The engine as set forth in claim 7 additionally comprising an axis along which the fastener extends, the recess being disposed between the axis and the guide opening.

9. The engine as set forth in claim 7, wherein the fastener comprises a bolt, the mounting boss defines a bolt hole into which the bolt is fitted, and an imaginary cylindrical projection extending straight along an axis of the bolt hole toward an interior of the engine body, intersects, at least in part, the recess.

10. An engine comprising an engine body, a guide opening, a member slidably mounted within the guide opening, a mounting boss disposed on an outer surface of the engine body configured to at least partially support a device exterior to the engine body, and a recess disposed between the guide opening and the mounting boss, wherein the recess is generally configured as a slot.

11. An engine comprising an engine body, a guide opening, a member slidably mounted within the guide opening, a mounting boss disposed on an outer surface of the engine body configured to at least partially support a device exterior to the engine body, and a recess disposed between the guide opening and the mounting boss, wherein the engine body comprises a cylinder head, the recess extending from an upper surface of the cylinder head to the position between the second end of the inner passage and the guide opening.

* * * * *